US005401563A

United States Patent [19]

Kurata et al.

[11] Patent Number: 5,401,563

[45] Date of Patent: Mar. 28, 1995

[54] TIER SHEETS

[75] Inventors: Akihide Kurata, Fujisawa; Akio Totsuka, Chiba, both of Japan

[73] Assignee: Nippon Petrochemicals Company, Limited, Tokyo, Japan

[21] Appl. No.: 735,290

[22] Filed: Jul. 24, 1991

[30] Foreign Application Priority Data

Jul. 27, 1990 [JP] Japan ..... 2-200011

[51] Int. Cl.[6] ..... B32B 7/02; B32B 3/02

[52] U.S. Cl. ..... 428/212; 428/156; 428/172; 428/192; 428/409; 428/141

[58] Field of Search ..... 428/156, 172, 212, 141, 428/192, 213, 409, 500, 515, 516, 519

[56] References Cited

U.S. PATENT DOCUMENTS

| | | | |
|---|---|---|---|
| 3,219,203 | 11/1965 | Jeramiah | 214/6 |
| 3,776,145 | 12/1973 | Anderson | 108/51 |
| 4,367,511 | 1/1983 | Crass et al. | 428/156 |
| 4,408,365 | 10/1983 | Palmer | 428/167 |
| 4,415,618 | 11/1983 | McClung | 428/172 |
| 4,587,147 | 5/1986 | Keith | 428/150 |
| 4,614,680 | 9/1986 | Fry et al. | 428/172 |
| 4,681,401 | 7/1987 | Wyckoff | 428/143 |

FOREIGN PATENT DOCUMENTS

| | | |
|---|---|---|
| 0096536 | 12/1983 | European Pat. Off. . |
| 50-136189 | 10/1975 | Japan . |
| 50-143686 | 11/1975 | Japan . |
| 60-238339 | 11/1985 | Japan . |
| 82/01861 | 6/1982 | WIPO . |

*Primary Examiner*—Donald J. Loney

*Attorney, Agent, or Firm*—Scully, Scott, Murphy & Presser

[57] ABSTRACT

An improved tier sheet and method for producing the same. The tier sheet is suitable for use in conveying receptacles such as cans and bottles with palletizing and depalletizing operations and it can allow the smooth sliding of receptacles in loading and unloading and can avoid the slipping off of receptacles during conveying operation. The tier sheet comprises a first zone having a first frictional resistance and a second zone having a second frictional resistance, wherein the second frictional resistance is lower than the first frictional resistance. The method of the invention comprises a feeding means to feed a tier sheet material, a forming means to form the first zone and the second zone, and a cutting means to cut the formed tier sheet.

12 Claims, 6 Drawing Sheets

TIER SHEETS

BACKGROUND OF THE INVENTION

1. Field of the Invention

This invention relates to tier sheets and a method for producing the same. More particularly, the invention relates to tier sheets which are used for the conveying operation of various kinds of receptacles such as cans and bottles.

The tier sheet according to the present invention is characterized in that it comprises a first zone having a first frictional resistance and a second zone having a second frictional resistance, wherein the second frictional resistance is lower than the fist frictional resistance. It is preferable that the first zone having first frictional resistance which is higher than the value of second frictional resistance, is formed at least in peripheral regions of the tier sheet.

2. Description of Prior Art

The tier sheet of this kind is suitably used for the palletizing and depalletizing of receptacles and containers. The tier sheet can prevent receptacles from slipping down during conveying or transporting operation, thereby improving the safety and efficiency of such a kind of work.

The palletizing operation generally comprises the following steps:

(1) A certain number of rows of empty cans are placed on a conveyor, and they are pushed forth on to a tier sheet. Another tier sheet is then put on the cans and another layer of cans is again put on the tier sheet, thereby stacking the layers of the cans to prepare a unit load.

(2) The layered unit load is applied with bands such as those made of polypropylene.

(3) The banded unit load is then wrapped with a shrinkable film.

(4) The unit load which is wrapped with a shrinkable film is then placed in a storage or conveyed by a forklift truck.

(5) The unit loads are then transported by a motortruck.

The depalletizing operation comprises the steps which are reverse to the above steps, that is:

(1) A transported unit load that is wrapped with a shrinkable film is opened.

(2) The bands applied on the load are taken off, and (3) Each layer of goods in the unit is shifted one by one onto a conveyor and sent to a next operation site such as a filling factory.

In recent years, various kinds of receptacles are used in several fields of industry. Receptacles made of metals such as aluminum and steel are used for refreshing drinks, beer, edible oil and canned goods. Glass bottles are used for pharmaceuticals, industrial chemicals and liquid seasonings. Plastic receptacles are used for liquid detergents, food additives and ice cream. Most operation for handling these goods are mechanized or automated.

As a mode of handling and conveying these receptacles, there is proposed a unit load system. In this system, when receptacles are conveyed, a certain number or weight of the receptacles are arranged into one unit and the unit is conveyed intact by transporting machines without unpacking the unit in the route of conveying. That is, a certain number of receptacles are arranged in a plurality of rows and they are stacked in layers, which is followed by wrapping with a shrinkable film and banding for conveying operation.

When empty receptacles are arranged in layers and formed into a unit of load for the purpose of washing, sterilizing or conveying operation, fiber boards or plastic sheets are interposed between adjacent layers of receptacles in order to stabilize them, to avoid the breakdown of the load and to prevent the load from contamination with sundry germs. These sheets which are inserted between layers of goods are called as "tier sheets".

In the palletizing or depalletizing operation or in the washing or sterilizing of receptacles, the tier sheet of this kind (hereinafter sometimes referred to as "sheet", simply) must be slippery because receptacles are caused to slide on the tier sheet. On the other hand, it is necessary that the receptacles must not be slipped down from the tier sheet during the conveying operation with a conveyor, forklift truck or motortruck. Accordingly, conflicting properties to allow slipping and to avoid slipping are simultaneously required of the tier sheet.

As the tier sheets, paper boards were generally used in the conventional art. However, the mechanical properties such as rigidity in bending and shock resistance are reduced when they absorb water or moisture. So that, they cannot be used repeatedly, which is disadvantageous in view of durability. In addition, because such a tier sheet is made of paper fiber, it is liable to become fuzzy which undesirably collects germs and dust. Furthermore, water washing and treatment with hot water are impossible, and satisfactory dust removal or sterilization cannot be done by means of washing with air shower or brushing, flaming or hot roll treatment. Therefore, the contamination of receptacles cannot be avoided and the use of paper-made tier sheet had been a problem in the fields of foods and pharmaceuticals.

As a measure to solve the above-mentioned problem, proposed in International Patent Publication WO 82/01861 is a tier sheet made of plastics which consists of a random copolymer of 2–10% of ethylene and 90–98% of propylene.

However, the conventional plastic-made tier sheet is provided with one smooth surface (specular surface), or with one smooth surface and the other rough surface. When receptacles are put on a rough surface, they are liable to slip because the coefficient of friction between receptacles and the rough surface of the sheet is low, which causes the slip down of receptacles during conveying. Method to avoid such slipping are proposed in Japanese Laid-Open Publication No. 50-136189 and No. 50-143686.

Meanwhile, if receptacles are put on smooth surface, especially on an entirely specular surface, the tier sheet is dragged during the loading or unloading in palletizing or depalletizing operation because the coefficient of friction between the receptacles and the tier sheet is high. As a result, receptacles are tumbled with causing troubles in handling.

BRIEF SUMMARY OF THE INVENTION

It is, therefore, the primary object of the present invention to solve the problems caused to occur in the conventional art.

More particularly, the object of the present invention is to facilitate the palletizing and depalletizing of receptacles and to avoid the slipping of receptacles during the conveying and transporting operation so as to attain the safety of operation and improvement in work efficiency.

Another object of the present invention is to provide an improved tier sheet and a method for producing the same, which tier sheet is excellent in mechanical strength, thermal resistance and antistatic property and which facilitates the water washing and sterilization when it is used for empty receptacles.

In order to solve the above-mentioned problems, the present inventors have carried out extensive investigations and experiments with regard to the tier sheet and, as a result, the present invention has been accomplished.

The present invention relates to a tier sheet which comprises a first zone having a first frictional resistance and a second zone having a second frictional resistance, wherein the second frictional resistance is lower than the fist frictional resistance.

Another aspect of the present invention relates to a method for producing a tier sheet which comprises a feeding means to feed a tier sheet material, a forming means to form a first zone having a first frictional resistance and a second zone having a second frictional resistance, wherein the second frictional resistance is lower than the fist frictional resistance, and a cutting means to cut the formed tier sheet.

BRIEF DESCRIPTION OF DRAWINGS

These and other objects and features of the present invention will become more apparent to those skilled in the art by the embodiments described with reference to the accompanying drawings, in which.

DETAILED DESCRIPTION OF PREFERRED EMBODIMENTS

The present invention will be described in more detail with reference to the accompanying drawings.

Figure 1:
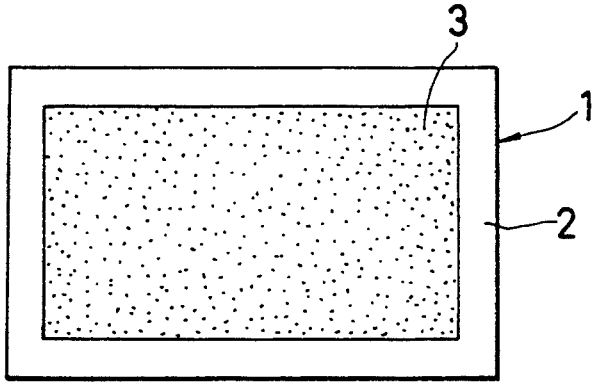
FIG. 1 is a plan view of an embodiment of the tier sheet according to the present invention.

Shown in FIG. 1 is n embodiment of a tier sheet of the present invention. The tier sheet 1 is provided in the peripheral portions with a first zone 2 having a first frictional resistance, which zone 2 is a smooth surface (specular surface). Inside of the first zone 2, a second zone 3 is formed which is a rough surface and which has a second frictional resistance that is lower than the first frictional resistance of the first zone 2. It is only necessary that the frictional resistance of the former first zone 2 is basically higher than the frictional resistance of the second zone 3 and the configuration and state of surface is not especially limited. For example, the first zone 2 is made as a smooth surface (specular surface) and the second zone 3 is made as a rough surface by treatment such as satin finish or fine grain emboss treatment. It is also possible to differentiate the first zone 2 in frictional resistance by laminating a nonslip material such as a nonslip tape or a rubber material. In another embodiment, the surface can be coated by an appropriate paint.

However, in view of convenience in preparation and controlling of frictional resistance and in view of economy, it is advisable to make the first zone 2 a smooth surface and make the second zone 3 a rough surface such as satin finish or embossed surface.

The degree of roughness in the second zone 3 may be determined in view of the shape, size and substance of receptacles to be placed on the tier sheet and the difference in the frictional resistance of the first zone 2 and that of the second zone 3. According to experiments carried out by the present inventors, the maximum height of the roughness is in the range of 5 to 200 μm (JIS B 0601), and preferably in the range of 10 to 150 μm.

The coefficient of friction of the second zone 3 is varied according to the kind of material of receptacles such as metal, glass or plastics, and also the configuration of the bottoms of receptacles and weight of receptacles to be placed, where the coefficient of static friction is suitably in the range of 0.1 to 0.6, and preferably in the range of 0.2 to 0.5.

It is desirably designed that the static friction coefficient of the first zone 2 is in the range of 0.2 to 0.7 and the difference in the coefficients of static friction of the first zone 2 and the second zone 3 is in the range of 0.01 to 0.4.

The width of the first zone 2 formed in the periphery of the tier sheet 1 is not limited because it is designed according to the size and configuration of receptacles, and the number of layers of receptacles. It is, however, generally in the range of 1 to 25 cm. In view of experiments, the ratio of the areas of the first zone 2 to the second zone 3 is in the range of 2–70% to 98–30%, preferably 3–65% to 97–35%, and more preferably 5–60% to 95–40%.

Figure 2:
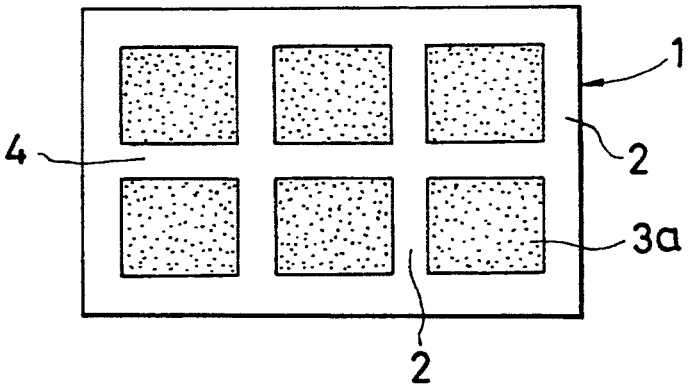
FIG. 2 is a plan view of another embodiment of the tier sheet of the present invention.

FIG. 2 is a plan view of another embodiment of the tier sheet of the present invention.

The tier sheet 1 is provided with smooth surfaces (specular surfaces) of first zones 2 having first frictional resistance in the peripheral portions and the crossed boundary portions 4. Thus, the second zones 3*a* having a second frictional resistance which is lower than the first frictional resistance, are divided into a plurality of regions. The number and total area of these second zones 3*a* can be determined appropriately according to the kind of receptacles to be placed thereon.

The configuration of the second zones 3*a* shown in FIG. 2 are square, however, it is possible that the second zones 3*a* are formed in a plurality of belts or other shapes, or in undetermined forms.

For example, the configuration of the second zones 3*a* may be belts as well as circles, triangles, squares, rectangles, polygons, diamonds, flower shapes, stars and cloud shapes in accordance with the configuration of receptacles to be placed and the number of stacked layers of receptacles.

The materials to form the tier sheet of the present invention are exemplified by thermoplastic resins of olefin polymers such as homopolymers of low, medium and high density polyethylene, polypropylene, polybutene-1, and poly-4-methylpentene-1, and copolymers of αolefins with main component of ethylene or propylene; polyamide resin; polyester resin; polyvinyl resin and their mixtures.

Among them, propylene polymers such as propylene homopolymer and block or random copolymer of propylene are especially desirable. More particularly, the olefin resin consisting of 100 to 50% by weight of propylene polymer and 0 to 50% of ethylene polymer and/or rubber is desirable because it is excellent in mechanical properties, thermal resistance and low temperature brittleness characteristic.

The above-mentioned rubber is exemplified by natural rubber and synthetic rubbers such as styrene-butadiene rubber, ethylene-propylene copolymer rubber, ethylene-propylene-diene copolymer rubber, butyl rubber and chloroprene rubber.

The thickness of the tier sheet of the present invention is generally in the range of 0.3 to 15 mm, and preferably selected from the range of 0.5 to 10 mm.

If the thickness of a tier sheet is less than 0.3 mm, the mechanical strength of the sheet is sometimes insufficient. On the other hand, when the thickness of the tier sheet is more than 15 mm, the handling of the sheet is troublesome.

Within the scope of the present invention, it is possible to apply the constitution of the tier sheet of the present invention to one or both surfaces of other substrate materials such as paper, plywood, metal plate and cloth. Or lamination with a thermoplastic sheet can be done.

In order to prevent the tier sheet from static electricity, an electroconductive material such as antistatic agent, metal powder, metal fiber, carbon black, or carbon fiber can be added. It is also possible to add other additives such as antioxidant, UV absorber, pigment, dye, cross-linking agent and foaming agent.

Figure 3:
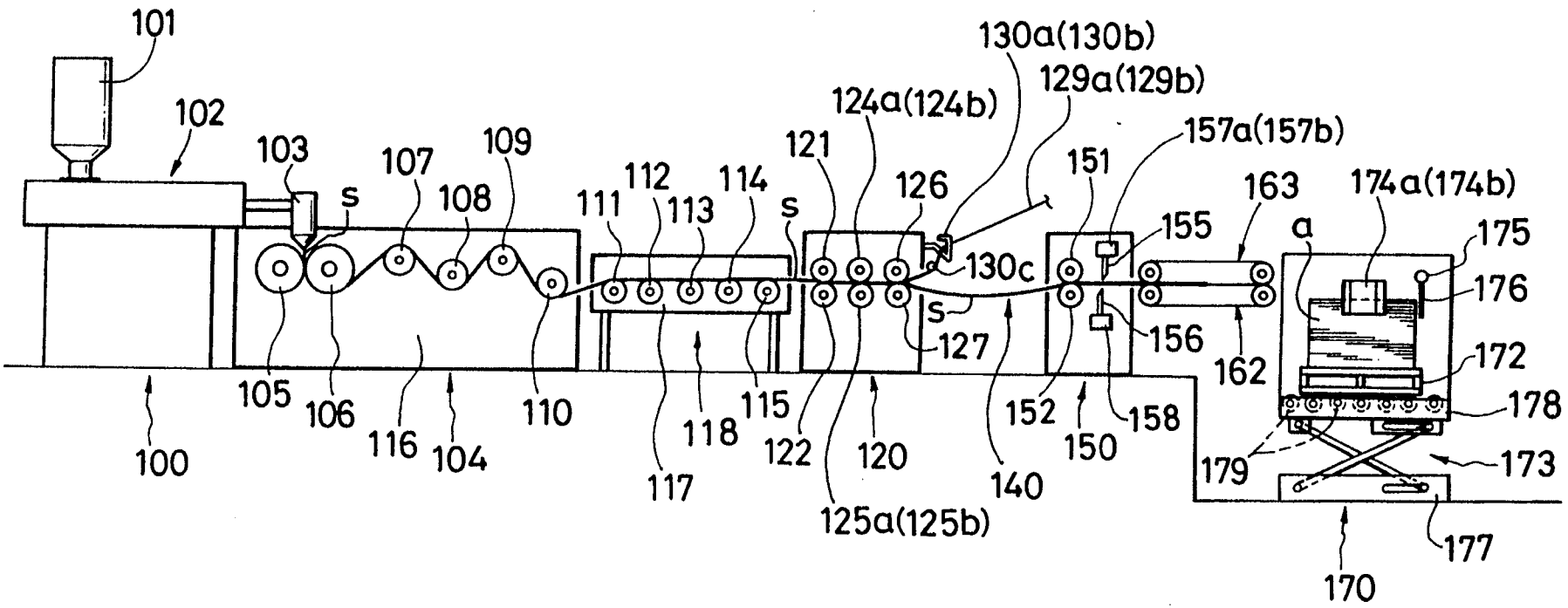
FIG. 3 is a schematic illustration of the apparatus for producing the tier sheet of the present invention.

In FIG. 3, an exemplar apparatus for producing the tier sheet of the present invention is schematically illustrated.

The tier sheet producing apparatus comprises a sheet feeding device 100, a forming device 104, an annealing device 118, an edge cutting device 120, a slackening zone 140, a sheet cutting device 150 and a sheet stacking device 170.

The sheet feeding means is composed of a sheet feeding device 100, in which pellets of synthetic resin containing a predetermined amount of additives is fed into the hopper 101 of an extruder 102. A molten sheet S of thermoplastic resin in a certain width is extruded from the T-die 103 of the extruder 102.

The sheet feeding means may be replaced by a previously formed resin sheet. When such a resin sheet is used, it is desirable that the sheet is heated before it is fed to the next forming device.

The forming device 104 as a forming means comprises a pair of forming rolls 105, 106 and 107; annealing rolls 108 and 109; and a cooling roll 110. These rolls are pivotally supported by a frame 116.

The annealing device 118 is provided with freely rotatable guide rolls 111 to 115 and they are pivotally supported by a frame 117.

Figure 4A:
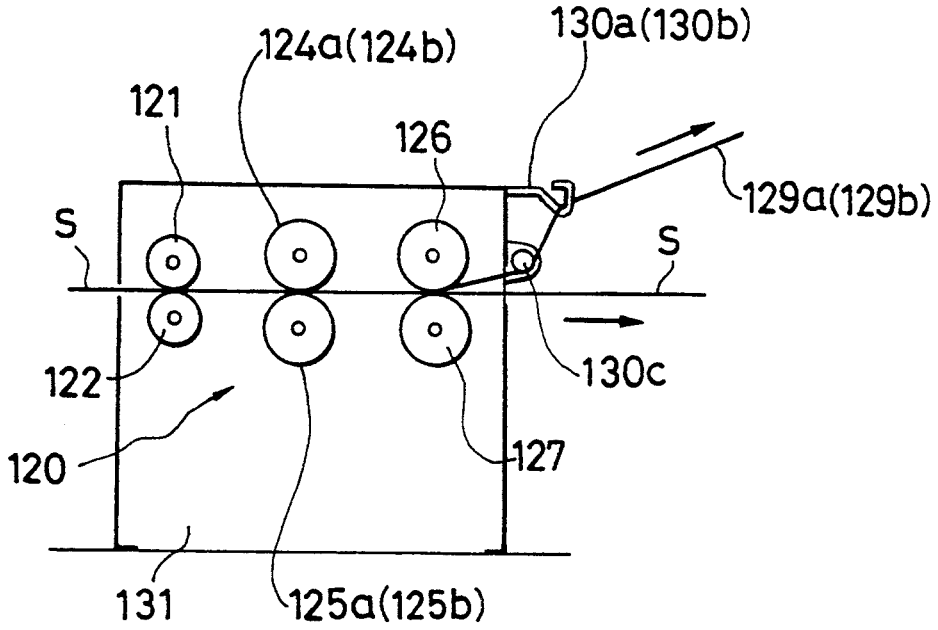
FIG. 4A is a side elevation of an edge cutting device.
Figure 4B:
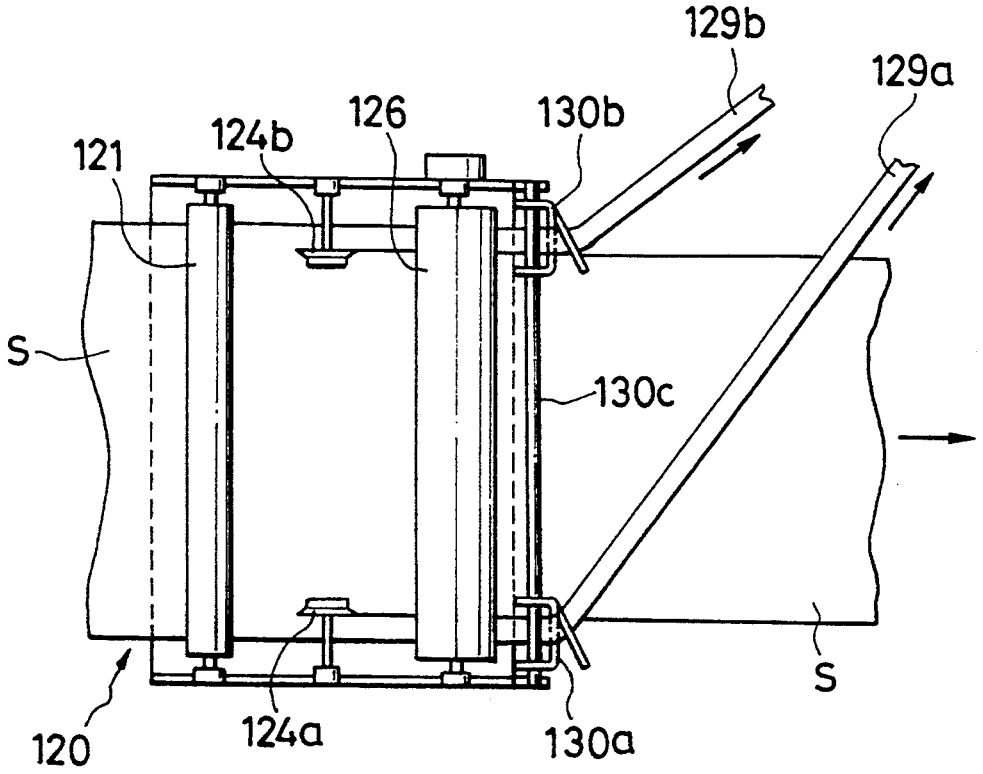
FIG. 4B is a plan view of the same edge cutting device.

As shown in detail in FIGS. 4A and 4B, the edge cutting device 120 is provided with pairs of rolls 121 and 122, and 126 and 127. Between these pairs of rolls, a pair of rotary cutting blades **124*a* and 125*a* are provided for trimming the edge on one side of the sheet S. Another pair of rotary cutting blades 124*b* and 125*b* are provided on the opposite side of the sheet S for trimming the other side edge. Next to the rolls 126 and 127, a bar 130*c* is attached, which bar 130*c* is located above and transversely to the sheet S. The cut-off portions 129*a* and 129*b* are lead out by bracket members 130*a* and 130*b* positioned above the bar 130*c*. The cut-off edge portions 129*a* and 129*b*** are subjected to size reduction by a crusher (not shown) and crushed material is recycled for reuse. Incidentally, the cut-off edge portions can be wound up for other uses or disposal.

Next to the above edge cutting device 120 is provided a slackening zone 140, in which the sheet S is temporarily hung slack. More particularly, the sheet S is stopped in the next cutting device 150 when the sheet S is cut as described later on, while the sheet S is continuously passed from the edge cutting device 120. Therefore, the supplied sheet S must be slackened in this slackening zone 140.

Figure 5A:
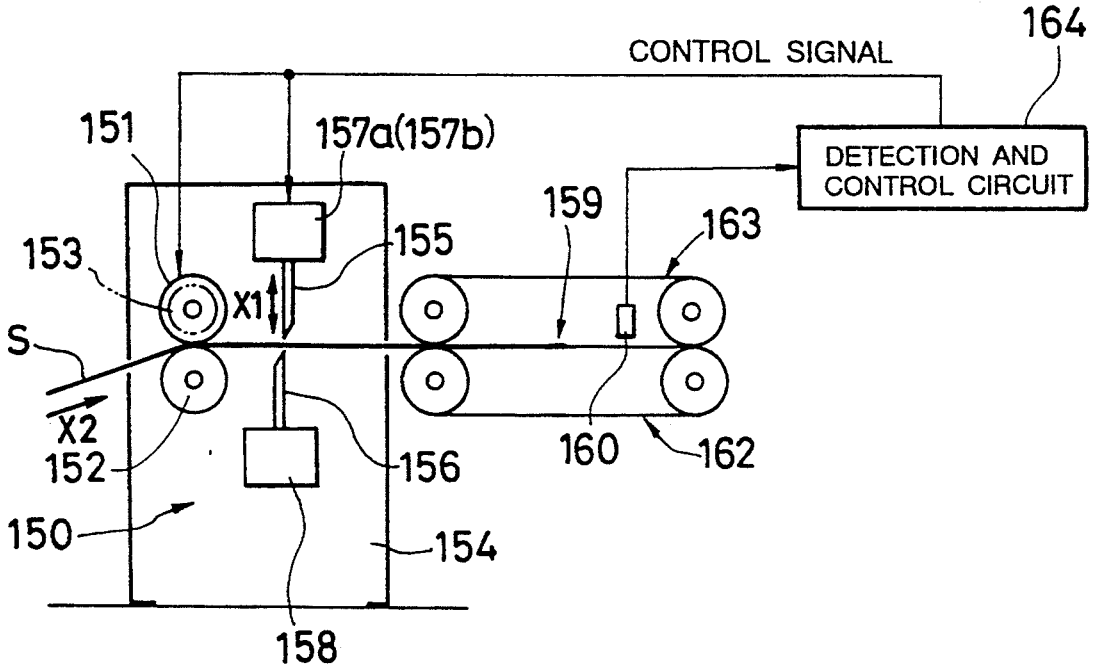
FIG. 5A is a schematic illustration of a sheet cutting device in side elevation.
Figure 5B:
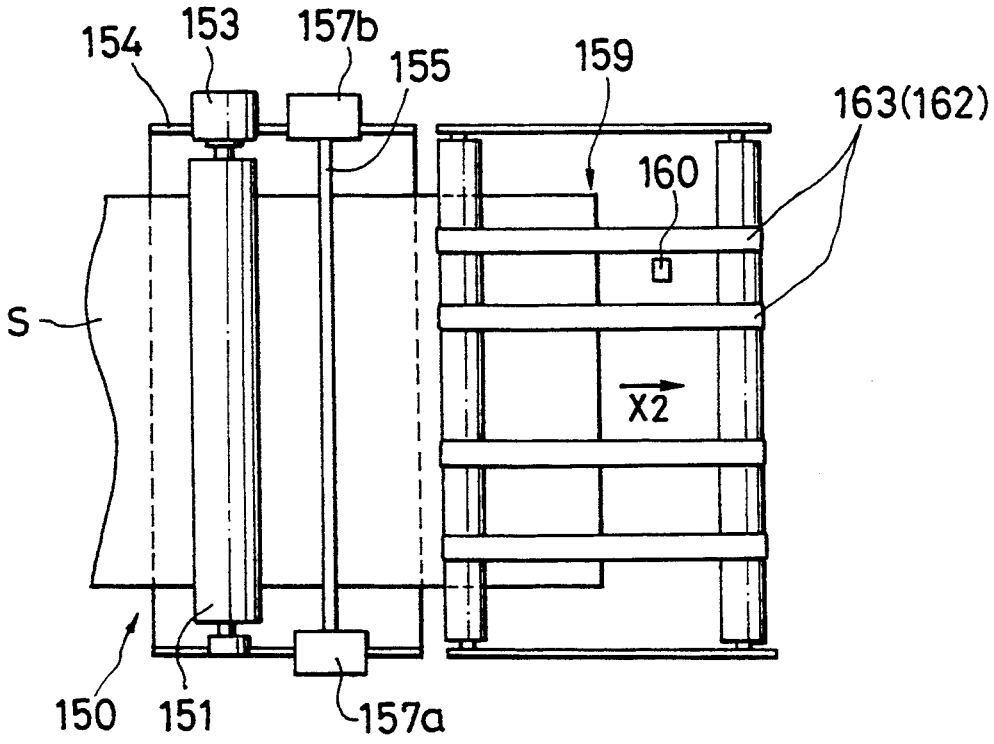
FIG. 5B is a plan view of the same sheet cutting device.

As shown in FIGS. 5A and 5B, the cutting device 150 as a cutting means is provided with a pair of feed rolls 151 and 152 and a pair of guillotine-type shear blades 155 and 156.

The feed rolls 151 and 152 are pivotally secured to a frame 154 and are driven by a driving device 153. The lower cutting blade 156 is fixed to the frame 154 by means of a securing member 158. The upper cutting blade 155 can be moved vertically by means of driving devices **157*a* and 157*b* in the direction of an arrow X1. The numeral 160 indicates a limit switch which detects the foremost end 159 of the sheet S. The signal of the limit switch 160 is transmitted to a detection and control circuit 164 which produces control signals to control the functions of the driving device 153 for the feed roll 151 and the driving devices 157*a* and 157*b* for the cutting blade 155**.

The detection and control circuit 164 detects that the foremost end 159 of the sheet S is brought into contact with the limit switch 160 and, at this moment, the circuit 164 produces signals to stop the feed rolls 151 and 152 and to slide down the cutting blade 155. By this action, the sheet S is cut by the cutting blades 155 and 156 at the moment of contact of the foremost end 159 of the sheet S with the limit switch 160, thereby forming a tier sheet a of predetermined size. The setting position of the limit switch 160 can be adjusted. The numerals 162 and 163 indicate conveyor belts for moving forth the above cut tier sheet a in the direction of an arrow X2.

Figure 6:
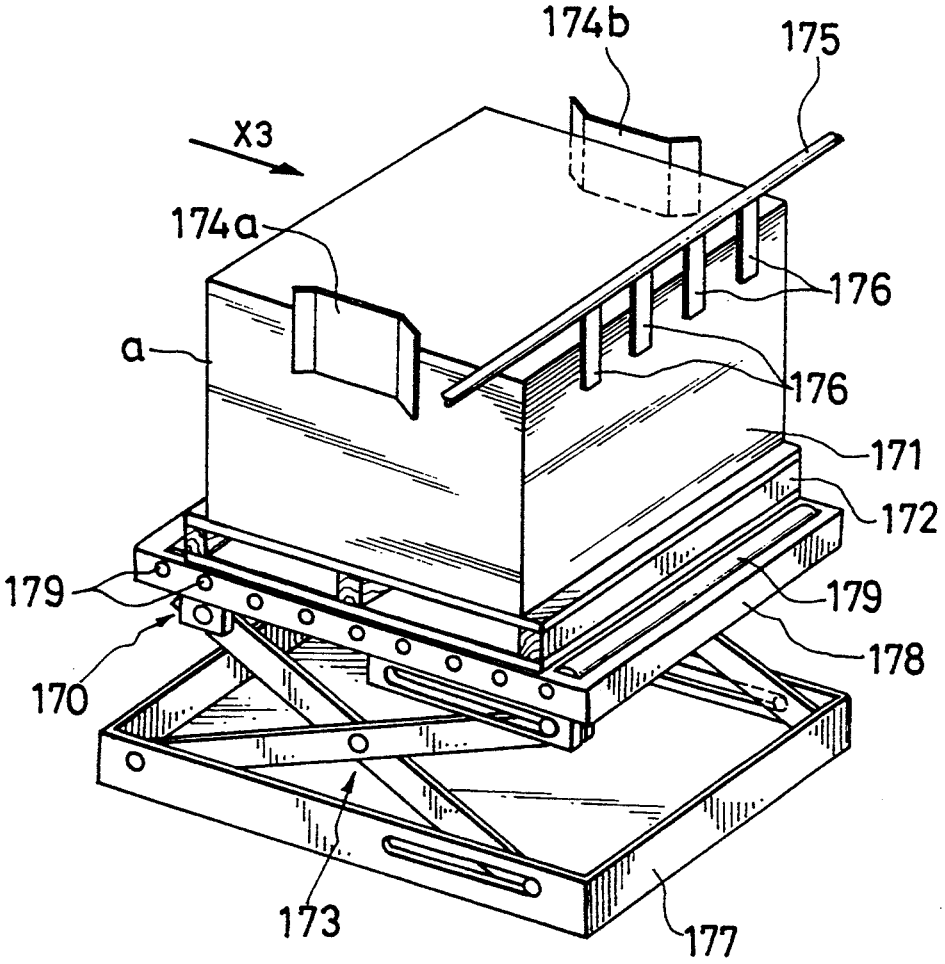
FIG. 6 is a perspective view of a stacking device.

The stacking device 170 receives tier sheets a from the conveyor belts 162 and 163 and stacks the sheets a. As shown in FIG. 6, the stacking device 170 comprises a base plate 177, a pantograph-type link mechanism 173 which is installed on the base plate 177, and a vertically movable supporting plate 178 attached to the link mechanism 173. For example, a wooden pallet 172 is put on this supporting plate 178 and the tier sheets a which are supplied from the direction of an arrow X3, are placed one by one on the pallet 172. The numeral 171 indicates stacked tier sheets a. The supporting plate 178 is provided with a plurality of rollers 179 to facilitate the unloading of tier sheets a from the wooden pallet 172. In operation, the supporting plate 178 is so moved vertically by the link mechanism 173 that the upper most part of the tier sheet a, i.e., the position to receive a next tier sheet a is a little lower than the position of the tier sheet a which is paid out from the conveyor belts 162 and 163. The stacking device 170 is provided with locating members **174*a*, 174*b* and 176 in order to adjust the position of a tier sheet to the stacked on the tier sheets a (or on the wooden pallet 172**) when an additional tier sheet a is transferred from the direction of the arrow X3 and is put on the stack of the tier sheets. The members 176 are stoppers which are attached to a bar 175 that is secured to a frame (not shown). The tier sheet a transferred from the direction of the arrow X3 is stopped by these stopper members 176, thereby attaining correct alignment in the direction of the movement of tier sheets a. The members 174*a* and 174*b* are also attached to a frame and are located at the position where a tier sheet a is introduced on the uppermost point of the stacked tier sheet a, thereby adjusting the transversal position of tier sheets a.

In the following, the method for producing the tier sheet made of polyolefin resin using the foregoing apparatus will be described.

Figure 7:
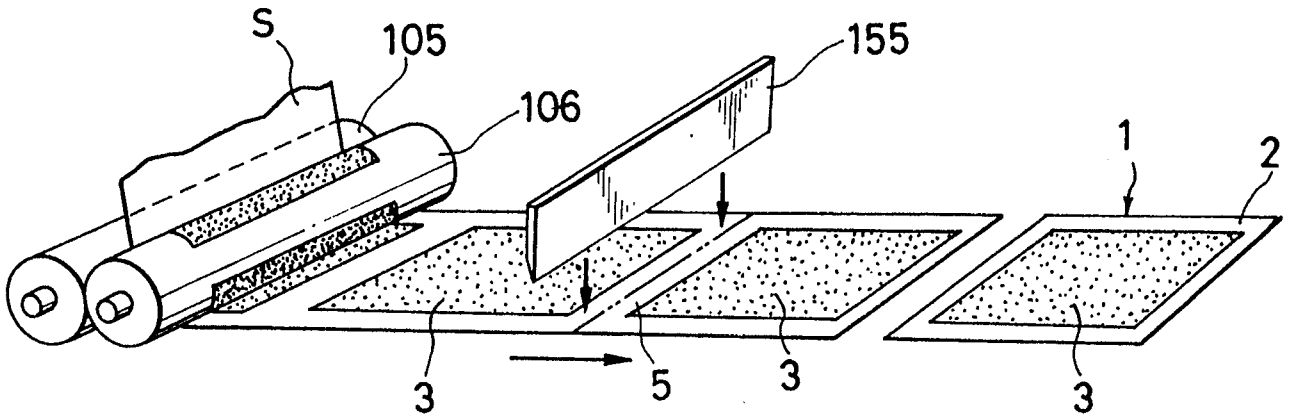
FIG. 7 is a schematic illustration of the step of forming rolls and the step of cutting the formed sheet material.

A hopper 101 is fed with polyolefin resin containing predetermined quantities of additives such as antioxidant and the resin is extruded from the T-die 103 in the form of a molten resin sheet S, which is fed to the forming device 104. In the forming step, the forming rolls form a first zone having a higher frictional resistance (e.g. smooth specular surface) at least in the peripheral portion of the sheet S and a second zone (e.g. embossed surface) having a frictional resistance lower than that of the first zone in the remainder portion of the sheet S. The temperature of forming is in the range of 200° to 260° C., preferably in the range of 220° to 240° C. The strain in the formed sheet S caused in the forming step is eliminated by the annealing device 118 at a temperature in the range of 50° to 140° C. The sheet S is then trimmed in the edge cutting device 120 to a predetermined width. In the next cutting device 150, the middle portion 5 (see FIG. 7) of the first zone of a sheet S having a higher frictional resistance and the first zone of succeeding formed sheet S, is cut by a cutting blade 155. The cut sheet is then transferred to a sheet stacking device 170 and stacked one by one. The stack of sheets is then conveyed by a forklift truck for storage or delivery.

In the above forming step of the preparation of the tier sheet a of the present invention, it is desirable that at least one of the pair of forming rolls is used at a roll temperature of 20° to 110° C., preferably 50° to 100° C. in order to avoid the sticking of the sheet S to the roll.

When the embossing is performed to form the second zone having a lower frictional resistance, an embossing roll having a surface roughness of 2 to 200 μm in maximum height is preferably employed in order to maintain the effect of the foregoing tier sheet.

A prescribed number of the thus prepared tier sheets are bundled in the stacking device 170 and it is then taken out.

As described above, the tier sheet of the present invention is provided with a first zone having a higher frictional resistance on one or both sides thereof and a second zone having a frictional resistance which is lower than that of the first zone. Therefore, the receptacles are not fallen off from the tier sheet by the shock given in transferring. In addition, the tier sheet is not dragged by receptacles placed on the sheet and the load is prevented from the occurrence of breakdown in palletizing or depalletizing operation because the inner part of the sheet is low in frictional resistance.

Furthermore, it is possible for the sheet of the present invention to improve the thermal resistance and antistatic property by adding inorganic fillers and electroconductive fibers to the material of the sheet. The tier sheet of this kind is quite suitable for washing and sterilizing when it is used for empty receptacles.

EXAMPLE 1

Preparation of Tier Sheet

Homopolypropylene (MFR=1.0 g/10 min., trademark: NISSEKI POLYPRO J 120G, made by Nippon Petrochemicals Co., Ltd.) was extruded by using a 90 mmϕ extruder. It was then subjected to the forming step with the above-mentioned apparatus at 240° C. in forming temperature, 70° C. in cooling roll temperature, 20 μm in the roughness of forming roll, and 5 m/min. in taking-up speed to obtain a sheet of 1.0 mm in thickness and 1500 mm in width. From this sheet, tier sheets of 1440×1130 mm having rounded corners (25 mm radius) were obtained.

| Properties of Tier Sheets | |
|---|---|
| Size of sheet | 1440 (L) × 1130 (W) × 1.0 (T) |
| First zone having a higher frictional resistance (specular surface) | Coefficient of friction to metal can: 0.3 |
| Second zone having a lower frictional resistance (satin finish) | Coefficient of friction to metal can: 0.24 |
| Yield strength (Kg/cm$^2$) | MD/CD = 223/180 |
| Breaking strength (Kg/cm$^2$) | MD/CD = 194/163 |
| Elongation percentage (%) | MD/CD = 80/80 |
| Flexural elastic modulus | MD/CD = 15,700/15,200 |
| Izod impact strength (Kg · cm/cm) | 3.5 |
| Thermal deformation temperature | 130° C. |

Note: MD means "machine direction"; CD, "cross direction"

Test of Loading, Unloading and Transportation

Empty metal cans (diameter: 52.8 mm, height: 133 mm, weight: 43.3 g) were arranged in 20×20 rows. They were stacked in 16 layers with interposing the above tier sheet between adjoining layers to obtain unit loads. With these unit loads, transportation tests were carried out.

The tests were done through the following procedure:

Palletizer—Chain Conveyor—Polypropylene—Bundling—Shrinkable Film Wrapping—Forklift Truck—Storage—Forklift—Motortruck—Forklift—Chain Conveyor—Depalletizer The results of this test are shown in the following Table 1.

TABLE 1

| Width of peripheral specular surface (mm) | Percentage of specular surface (%) | Results of Test |
|---|---|---|
| 3 | 0.9 | Cans were slipped down during transferring with a conveyor. |
| 5 | 1.6 | |
| 10 | 3.1 | No slipping down of cans. No problem in loading and unloading in palletizing and depalletizing. |
| 50 | 15.2 | |
| 150 | 41.8 | |
| 200 | 53.3 | |
| 250 | 63.6 | |
| 300 | 72.6 | Tier sheet was dragged by |

TABLE 1-continued

| Width of peripheral specular surface (mm) | Percentage of specular surface (%) | Results of Test |
|---|---|---|
| 350 | 80.4 | cans in loading and unloading. |

Notes:
The palletizer is a packing machine in which rows of cans are received from a conveyor onto a tier sheet and the rows of cans are pushed to the inner part of the tier sheet with a pusher, the next row of cans are then received and pushed inside to arrange the rows of cans on the tier sheet.
Depalletizer is an unloading machine in which the cans on a tier sheet are moved onto a conveyor with a pusher.
The conditions for the shrinkable film wrapping were 60μ in film thickness and 150° C. for 1 minute in heating.

EXAMPLE 2

Pelletizing was carried out by a biaxial extruder with 100 parts by weight of the polypropylene homopolymer used in Example 1, and 5 parts by weight of talc (trademark: PK-C, made by Hayashi Kasei Co., Ltd., average particle diameter: 10 μm, moisture: 0.13%, white scaly powder), 10 parts by weight of carbon fiber (trademark: GRANOC, made by Nippon Oil Co., Ltd., diameter: 7 μm, length: 0.2 mm) and 0.2 parts by weight of titanium dioxide (rutile type, class 1 specified in JIS K 5116). The pellets were then formed into tier sheets with the apparatus used in Example 1 at 240° C. in forming temperature, 70° C. in cooling roll temperature and 1.5 m/min. in taking-up speed to obtain a sheet of 1.0 mm in thickness and 1500 mm in width. The peripheral smooth surface (specular surface) was 100 mm in width (ratio in area: 29.1%) and 0.3 in coefficient of friction. The inner part of rough surface was 70.9% in ratio of area and 0.24 in coefficient of friction. From this sheet, tier sheets of 1440×1130 mm having rounded corners (25 mm radius) were obtained.

Soaking test and heat-cycle test were carried out using the above tier sheets. The results are shown in the following Table 2.

| Test Items | Test Methods |
|---|---|
| Tensile strength test | JIS K 6911 |
| Flexural elastic modulus | JIS K 7203 |
| Izod impact strength (with notch) | JIS K 7110 |
| Deflection temperature (4.6 Kg) | ASTM D 648 |
| Surface resistivity | JIS K 6911 |

The sheet was scrubbed with a cotton gauze 30 times and it was dusted with dry ash of cigarette. The degree of clinging of the ash was observed with naked eyes.

Evaluation: 0=None

Δ=A little ash was attached

X=Much ash was attached

Soaking test:

A test piece of 150 mm×150 mm was soaked in a hot water bath at 90° C. for 5 minutes and the test piece was taken out to cool in the air. This treatment was repeated 50 times and surface resistivity was then measured.

Heat cycle:

Empty coffee cans (250 g) were put on a test sheet of 300 mm×300 mm in the arrangement of 6×6 cans. Another test sheet of the same size was put on the rows of cans and other cans were put on the test sheet likewise. On the layers of cans, another test sheet was placed and on this sheet, a plate of 10 Kg was placed. This unit was put in an air oven for 2 minutes at 160° C. and cooled in the air. This treatment was repeated 50 times. After that, the deformation by heating was observed.

TABLE 2

| Properties of Tier Sheet | | | |
|---|---|---|---|
| Flexural elastic modulus (Kg/mm$^2$) MD/CD = 58,000/27,000 | | | |
| Izod impact strength (Kg · cm/cm) | | 7.0 | |
| Deflection temperature (°C.) | | 143° C. | |
| Surface resistivity (Ω) | | $10^4$ | |
| Ash test | | 0 | |
| **Soaking Test** | | **Before test** | **After test** |
| Tensile yield strength (Kg/cm$^2$) | MD/CD | 450/310 | 440/315 |
| Flexural elastic modulus (Kg/mm$^2$) | MD/CD | 58,000/27,000 | 57,000/28,000 |
| Surface resistivity (Ω) | | $10^4$ | $10^4$ |
| Ash test | | 0 | 0 |
| **Heat Cycle Test** | | **Before test** | **After test** |
| Tensile yield strength (Kg/cm$^2$) | MD/CD | 450/310 | 440/315 |
| Elongation at breaking point (%) | MD/CD | 10/50 | 10/50 |
| Flexural elastic modulus (Kg/mm$^2$) | MD/CD | 58,000/27,000 | 57,000/28,000 |
| Deformation value | | None | None |
| Surface electrical resistance (500 V load, Ω · cm) | | $2 \times 10^4$ | $2 \times 10^4$ |
| Half-value period of applied voltage (10 kV, 20 sec.) | | Almost no charge | Almost no charge |

EXAMPLE 3 and COMPARATIVE EXAMPLES 1 and 2

Three kinds of tier sheets were prepared.

Sheet (A):

The same sheet as those used in Example 2.

Sheet (B):

The sheet having the same composition as that of Example 2 but all the surface was rough surface of a frictional resistance of 0.24.

Sheet (C):

The sheet having the same composition as that of Example 2 but all the surface was specular surface of a frictional resistance of 0.3.

By repeating the test 10 times in like manner as in Example 1 to examine the properties and durability, the drag and abrasion of tier sheets caused by the sliding of cans in palletizer and depalletizer, the deformation of tier sheets in the shrinkable film wrapping (film thickness: 60μ, heating: 150° C. for 1 minute), and influences of them to the transferring by a conveyor and transportation by a motortruck were observed.

The results of the above tests were shown in the following Table 3.

TABLE 3

| Examples | Example 1 | Comp. Ex. 1 | Comp. Ex. 2 |
|---|---|---|---|
| Sheet | Sheet (A) of invention | Sheet (B) of all rough surface | Sheet (C) of all specular surface |
| Frictional resistance to metal cans | Periphery /inside 0.30/0.24 | 0.24 | 0.30 |
| Ratio of areas | 29.1/70.9 | 100 | 100 |
| Drag of sheet in palletizer and depalletizer | None | None | Drag occurred in all sheets. Test couldn't be continued. |
| Abrasion of sheets in palletizing and depalletizing | None | None | — |

TABLE 3-continued

| Examples | Example 1 | Comp. Ex. 1 | Comp. Ex. 2 |
|---|---|---|---|
| Slipping down of cans in conveyor line | None | 32% of cans slipped down | — |
| Change of sheet in shrinkable film wrapping | No change | No change | — |
| Tumbling of cans in transporting by motortruck | None | None | — |

It was understood that the tier sheet (A) prepared according to the present invention was most excellent.

As described above, the tier sheet of the present invention is provided on one side or both sides with a first zone or zones having a first frictional resistance and a second zone or zones having a second frictional resistance in the inside portion of the first zone or zones, in which the second frictional resistance is lower than the first frictional resistance. With this constitution, the falling down of receptacles and break down of load caused by the sliding operation in the loading or unloading in palletizing or depalletizing, can be avoided because the frictional resistance of the inner part of the tier sheet is low; and the receptacles are not dropped during the conveying operation because the frictional resistance is high in the periphery of the tier sheet.

What is claimed is:

1. A tier sheet for conveying receptacles thereon comprising a polyolefin which is provided in one surface with a first zone of a specular surface being formed in the peripheral portion of said tier sheet and having a first frictional resistance and a second zone of a rough surface having a second frictional resistance which is lower than said first frictional resistance.

2. The tier sheet as claimed in claim 1, wherein the other surface of the tier sheet is also provided with a first zone having a first frictional resistance and a second zone having a second frictional resistance, said second frictional resistance being lower than said first frictional resistance.

3. The tier sheet as claimed in claim 1, wherein said first zones having a first frictional resistance are formed in the peripheral portions and crossed boundary portions, thereby forming a plurality of said second zones having a second frictional resistance.

4. The tier sheet as claimed in claim 1, wherein the difference in coefficients of static friction between said first zone having a first frictional resistance and said second zone having a second frictional resistance, is in the range of 0.01 to 0.4.

5. The tier sheet as claimed in claim 1, wherein the ratio of the area of said first zone having a first frictional resistance to the area of said second zone having a second frictional resistance, is in the range of 2–70% to 98–30%.

6. The tier sheet as claimed in claim 1, wherein said tier sheet is made of polyolefin resin having a thickness of 0.3 to 15 mm.

7. The tier sheet as claimed in claim 6, wherein 50% by weight of inorganic filler is added to said polyolefin resin.

8. The tier sheet as claimed in claim 7, wherein inorganic filler is at least one member selected from the group consisting of talc, calcium carbonate, electroconductive fiber and glass fiber.

9. The tier sheet as claimed in claim 1, wherein said tier sheet is of a laminated structure prepared by laminating a sheet having a first frictional resistance with another sheet having a second frictional resistance.

10. A tier sheet as claimed in claim 1 wherein said first zone has a first coefficient of friction in the range of 0.1–0.6 and said second zone has a second coefficient of friction in the range of 0.2–0.7.

11. A tier sheet as claimed in claim 10, wherein the coefficient of friction for the first zone is in the range of 0.2 to 0.5.

12. A tier sheet as claimed in claim 6, wherein said polyolefin resin consists of a) 50 to 100% by weight of polypropylene and b) 0 to 50% of rubber.

* * * * *

UNITED STATES PATENT AND TRADEMARK OFFICE

CERTIFICATE OF CORRECTION

PATENT NO. : 5,401,563

DATED : March 28, 1995

INVENTOR(S) : Akihide Kurata, et al.

It is certified that error appears in the above-indentified patent and that said Letters Patent is hereby corrected as shown below:

Column 9, line 48, insert --Ash test:--.

Signed and Sealed this

Twenty-seventh Day of February, 1996

*Attest:*

*Attesting Officer*

BRUCE LEHMAN

*Commissioner of Patents and Trademarks*